US009093038B2

(12) United States Patent
Han et al.

(10) Patent No.: US 9,093,038 B2
(45) Date of Patent: Jul. 28, 2015

(54) SHARE-CAPACITOR VOLTAGE STABILIZER CIRCUIT AND METHOD OF TIME-SHARING A CAPACITOR IN A VOLTAGE STABILIZER

(75) Inventors: Byung-hun Han, Seoul (KR); Jae-goo Lee, Yongin-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 1006 days.

(21) Appl. No.: 12/784,200

(22) Filed: May 20, 2010

(65) Prior Publication Data

US 2011/0090212 A1 Apr. 21, 2011

(30) Foreign Application Priority Data

Oct. 21, 2009 (KR) ..... 10-2009-0100308

(51) Int. Cl.
*G09G 3/36* (2006.01)
*G09G 3/32* (2006.01)

(52) U.S. Cl.
CPC ..... *G09G 3/3614* (2013.01); *G09G 3/3696* (2013.01); *G09G 3/3648* (2013.01); *G09G 2330/02* (2013.01)

(58) Field of Classification Search
CPC G09G 3/3614; G09G 3/3648; G09G 2330/02
USPC ..... 345/87–104, 204–206, 208–213
See application file for complete search history.

(56) References Cited

U.S. PATENT DOCUMENTS

| | | | | |
|---|---|---|---|---|
| 5,929,847 | A * | 7/1999 | Yanagi et al. | 345/204 |
| 6,331,846 | B1 * | 12/2001 | Nakao | 345/96 |
| 7,138,993 | B2 * | 11/2006 | Herrmann | 345/211 |
| 7,282,985 | B2 * | 10/2007 | Yen et al. | 327/536 |
| 7,518,603 | B2 * | 4/2009 | Yamamoto et al. | 345/211 |
| 7,760,163 | B2 * | 7/2010 | Jo | 345/76 |
| 2005/0047180 | A1 * | 3/2005 | Kim | 363/59 |
| 2006/0055576 | A1 * | 3/2006 | Boemler | 341/155 |
| 2007/0109735 | A1 * | 5/2007 | Yamazaki et al. | 361/683 |

* cited by examiner

*Primary Examiner* — Amr Awad
*Assistant Examiner* — Stephen Bray
(74) *Attorney, Agent, or Firm* — F. Chau & Associates, LLC

(57) ABSTRACT

A voltage stabilizer circuit for alternately or simultaneously stabilizing first and second generated voltages includes shared capacitor connected between the first and second generated voltages. The voltage stabilizer circuit may further include first and second switches for alternately connecting the first and second electrode of the shared capacitor to a ground. The alternation of the stabilized first and second voltages output by the voltage stabilizer circuit can be synchronized with a pixel polarity inversion mode signal output by the internal driver circuit of an LCD display.

19 Claims, 8 Drawing Sheets

FIG. 2B1
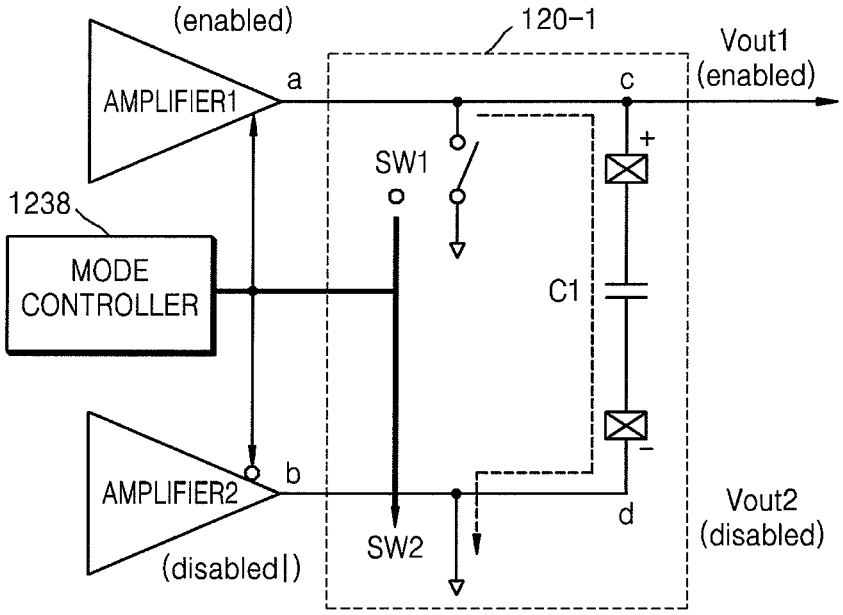
FIG. 2B2
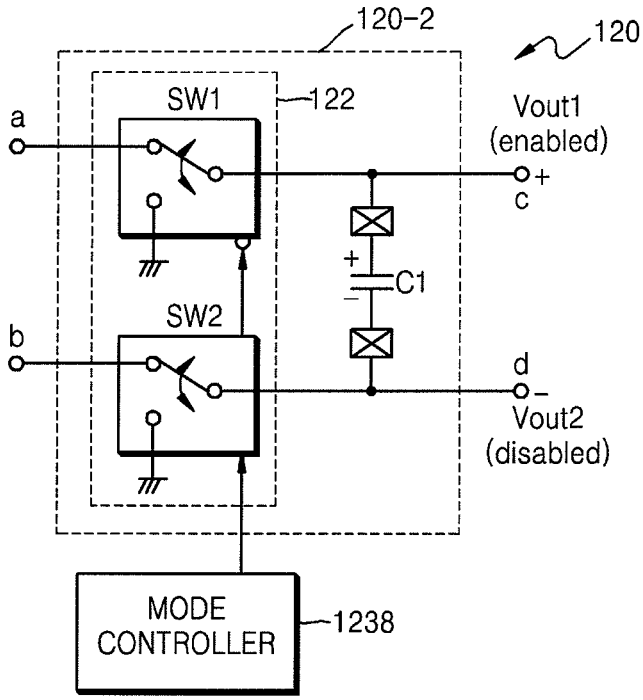

SHARE-CAPACITOR VOLTAGE STABILIZER CIRCUIT AND METHOD OF TIME-SHARING A CAPACITOR IN A VOLTAGE STABILIZER

CROSS-REFERENCE TO RELATED APPLICATION

This application claims priority under 35 U.S.C. §119 to Korean Patent Application No. 10-2009-0100308, filed on Oct. 21, 2009, the disclosure of which is incorporated by reference herein in its entirety.

BACKGROUND

1. Technical Field

The present inventive concept relates to stabilizing outputs of voltage generators, and more particularly to a method of alternately stabilizing two generated voltages using a time-shared capacitor, an apparatus for driving a display device using a shared capacitor, and a display device having the shared capacitor.

2. Discussion of the Related Art

As mobile phone applications extend into such areas as high-resolution cameras, TV display functions, and game functions, larger volumes of information are being displayed and main screen resolution is improving to provide high-quality image displays, leading to increased use of 240×320 pixel (QVGA) resolution displays. In addition, the trend in future designs will be for the narrowest possible frame around the thinnest possible LCD panel in mobile phones, PDAs and portable media players.

A power supply in a liquid crystal display (LCD) module includes a direct-current to direct-current voltage converter (DC to DC converter), and a DC/AC backlight inverter. The DC to DC converter converts an external DC voltage from a power supply into a plurality of voltages for output to a logic circuit, and/or to a driver circuit, e.g., a gate-ON voltage VDD, a gate-OFF voltage VSS, a gamma reference voltage VREF for a data voltage, and a common voltage VCOM to an LCD panel. Generally, the voltage output to the logic circuit is about 5V or less (e.g., about 3.3V).

The internal driving circuit of the LCD outputs data to the gate lines of the LCD panel as discrete analog voltages. For example if an LCD panel displays 256 grey levels in each color pixel PX, then the internal driving circuit outputs a selected one of 256 analog voltages to each color-pixel. The 256 analog voltages are typically produced by a voltage divider comprised of a plurality of series-connected resistors.

FIG. 1B is a circuit diagram of a conventional double-throw switch SW in the internal driving circuit of a LCD connected indirectly to a pixel PX in an LCD panel 1240 of the LCD. Each pixel PX in the LCD panel 1240 of an LCD includes a liquid crystal layer that has a capacitance $C_{LC}$ and a storage capacitor that has capacitance $C_{st}$. A positive driving voltage Vout1/y and a negative driving voltage Vout2/y are alternately applied to the pixel PX through the double-throw switch in the internal driving circuit. The positive driving voltage Vout1/y is the positive voltage Vout1 output by a positive voltage generator (e.g., Amplifier1 in FIG. 1A) divided by a data-dependent variable divisor y using a voltage divider (not shown). The negative driving voltage Vout2/y is the negative voltage Vout2 output by a negative voltage generator (e.g., Amplifier2 in FIG. 1A) divided by a data-dependent variable divisor y using a voltage divider (not shown).

In each pixel on an LCD panel, the amount of light that is transmitted from the backlight through the LCD layer depends on the voltage (Vout1/y or Vout2/y) applied to the pixel. The amount of light transmitted does not depend on whether that applied voltage is negative (Vout2/y) or positive (Vout1/y). However, applying the same polarity of voltage to the same pixel PX for a long period of time would damage the pixel PX. In order to prevent damage, the internal driving circuit of the LCD displays quickly alternate the voltage between positive and negative for each pixel PX, which is called pixel inversion. In order to generate the alternating positive and negative pixel-driving voltages (Vout2/y, Vout1/y)., the internal driving circuit conventionally receives a plurality of negative driving voltages from the DC to DC converter and a plurality of positive driving voltages from the DC to DC converter at all times during operation of the LCD. Switches, (e.g., the double throw switch SW2), within the internal driving circuit alternately connect each pixel PX to the positive driving voltage Vout1/y and the negative driving voltage Vout2/y. Ideally, rapid polarity inversion isn't noticeable because every pixel has the same brightness whether a positive or a negative voltage is applied.

Referring to FIG. 1B a conventional double-throw switch can be implemented within the internal driving circuit as two single-throw (ON/OFF) switches connected in parallel to the same (output) node. Single-throw (ON/OFF) switches can be implemented as mechanical devices, or by semiconductor transistors. In internal driving circuits for LCD panels, ON/OFF switches are typically implemented as field effect transistors (FETs) formed in an integrated circuit. The double-throw switch SW is controlled by a control signal output by a conventional pixel polarity inversion mode controller 1238. The pixel polarity inversion mode controller 1238 controls the double-throw switch SW to alternately select the positive driving voltage Vout1/y and the negative driving voltage Vout2/y according to a predetermined inversion pattern (e.g., Line-paired RGB sub-pixel dot-inversion, line (e.g., row) inversion, frame inversion, etc.). In the first inversion mode, the double-throw switch SW selects the positive driving voltage Vout1/y and the second inversion mode the double-throw switch SW to selects the negative driving voltage Vout2/y.

A mobile display driver IC (Mobile DDI) may additionally include built-in non-volatile memory cells for storing gamma, configuration, and user settings, and thus the DC to DC converter may further be configured to output high voltages associated with erasing and programming non-volatile memory cells. The plurality of voltage outputs of the DC to DC converter may be implemented by one or more amplifiers, charge pumps, or voltage regulators. The internal driver circuit is regarded as a load of the voltage generator(s) of the DC to DC converter.

In designing the DC to DC converter, output voltage ripple and voltage drop are issues that need to be addressed because they can compromise operation characteristics and display quality. To mitigate the output voltage ripple and voltage drop, a voltage-stabilizing circuit comprising a plurality of capacitors is typically provided between the DC to DC converter and the internal driving circuit of the LCD. In a conventional stabilizing circuit, a capacitor is connected to each of the plurality of negative voltages output from the DC to DC converter and additional capacitors are connected to each among the plurality of positive voltages output from the DC to DC converter.

FIG. 1A is a circuit diagram of a conventional stabilizing circuit 12 connected to a positive and a negative output of a DC to DC converter of an LCD display. Referring to FIG. 1A, the conventional stabilizing circuit 12 comprises a second positive-stabilizing capacitor C2P for stabilizing a second positive voltage Vout1 output by Amplifier1, and a second negative-stabilizing capacitor C2N for stabilizing a second negative voltage Vout2 output by Amplifier2. In a typical LCD, the second positive voltage Vout1 and the second negative voltage Vout2 will have the same magnitude, but opposite polarities, relative to ground. And thus, second positive voltage Vout1 stabilizing capacitor C2P can have the same capacitance as the negative voltage Vout1 stabilizing capacitor C2N, and so the stabilizing capacitors C2P and C2N can be implemented by identical capacitors.

Each of the voltage stabilizing capacitors C2N, C2P is typically an exterior capacitor not formed on the integrated circuit(s) that comprise the internal driving circuit and/or the DC to DC converter. The exterior capacitors take up physical space in three dimensions on a printed circuit board outside the LCD panel, and tend to increase the size and weight of products containing LCDs, as well as increasing the part count and the production cost of such products.

SUMMARY

An aspect of the inventive concept provides a voltage stabilizer capable of alternately or simultaneously stabilizing first and second generated voltages that includes shared capacitor connected between the first and second generated voltages. Another aspect of the inventive concept provides a display device having the voltage stabilizer. The voltage stabilizer circuit may include first and second switches for alternately connecting the first and second electrode of the shared capacitor to a ground, so that stable voltages may alternately be provided. Therefore, stable driving voltages may be alternately applied to drive a display device. The alternation of the stabilized first and second voltages output by the voltage stabilizer circuit can be synchronized with a pixel polarity inversion mode signal output by the internal driver circuit of an LCD display.

An aspect of the inventive concept provides a voltage stabilizing circuit comprising a capacitor having a first electrode selectably connected to a first voltage node through a first switch and a second electrode selectably connected to a second voltage node through a second switch. The first stabilized voltage is output at the first voltage node while the first switch connects the first electrode to the first voltage node and while the second switch connects the second electrode to ground. The second stabilized voltage is output at the second voltage node while the second switch connects the second electrode to the second voltage node and while the first switch connects the first electrode to ground. The absolute value of the first stabilized voltage is preferably substantially the same as absolute value of the second stabilized voltage, measured relative to the ground.

Another aspect of the inventive concept provides a voltage stabilizing circuit comprising a first switch for switchably connecting the first electrode of a shared capacitor to ground, wherein the first electrode is connected to a first output node of the stabilizing circuit. The voltage stabilizing circuit may further comprise a second switch for switchably connecting the second electrode of the shared capacitor to ground, wherein the second electrode is connected to a second output node of the stabilizing circuit.

While the second switch connects the second electrode of the shared capacitor to ground and while the first electrode of the shared capacitor is not connected to ground (Operating Mode 1), the first output node of the voltage stabilizing circuit outputs a first stabilized voltage. While the first switch connects the first electrode of the shared capacitor to ground and while the second electrode of the shared capacitor is not connected to ground (Operating Mode 2), the second output node of the voltage stabilizing circuit outputs a second stabilized voltage. While neither the first electrode nor the second electrode of the shared capacitor is connected to ground (Operating Mode 3), the first output node of the voltage stabilizing circuit outputs a first stabilized voltage and the second output node of the voltage stabilizing circuit outputs a second stabilized voltage, and the potential difference between the first stabilized voltage and the second stabilized voltage is substantially the same as the voltage between the first electrode and the second electrode.

Preferably, the first stabilized voltage is positive while the second stabilized voltage is negative.

Another aspect of the inventive concept provides an apparatus comprising: the voltage stabilizing circuit described herein; a first voltage generator configured to generate a first voltage to be stabilized and output by the voltage stabilizing circuit as a first stabilized voltage; a second voltage generator configured to generate a second voltage to be stabilized and output by the voltage stabilizing circuit as a second stabilized voltage. The apparatus may further include a display panel (e.g., LCD, OLED), and an internal driving circuit of the display panel. The first and second stabilized voltages may be alternately stabilized and applied by the voltage stabilizing circuit to the internal driving circuit according to a pixel polarity inversion scheme of the display panel. This may be accomplished by having the first switch and the second switch alternately controlled (ON/OFF) by an output of the internal driving circuit based on the pixel polarity inversion scheme of the display panel.

BRIEF DESCRIPTION OF THE DRAWINGS

Hereinafter exemplary embodiments of the inventive concept will be described below in more detail with reference to the accompanying drawings. The inventive concept may, however, be embodied in different forms and should not be construed as limited to the exemplary embodiments set forth herein. Rather, these embodiments are provided so that this disclosure will be thorough and complete, and will fully convey the scope of the inventive concept to those skilled in the art. In the drawings:

FIG. 2B1 is a circuit diagram of the voltage stabilizer shown in FIG. 2A operating in a first mode;

FIG. 2B2 is a circuit diagram of an alternative implementation of the voltage stabilizer shown in FIG. 2A operating in the first mode;

DETAILED DESCRIPTION OF EXEMPLARY EMBODIMENTS

Figure 2A:
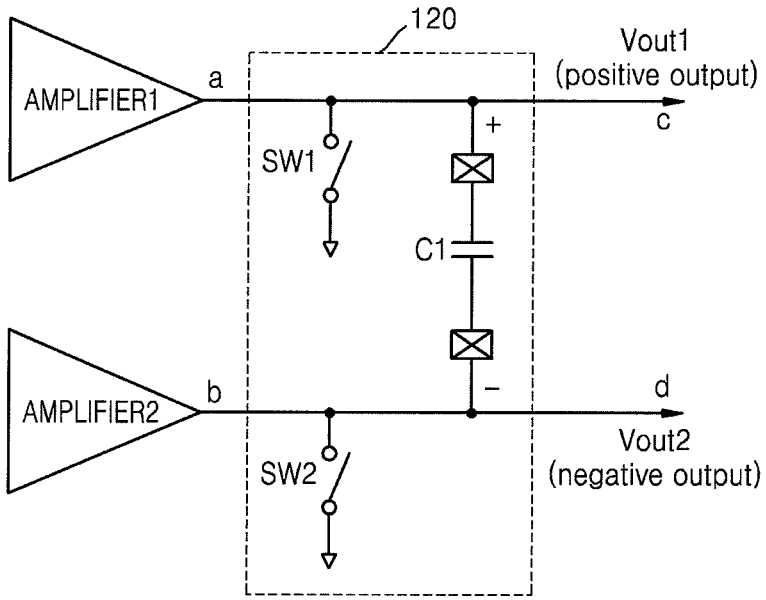
FIG. 2A is a circuit diagram of a voltage stabilizer in accordance with an exemplary embodiment of the inventive concept.

FIG. 2A is a circuit diagram of a voltage stabilizer 120 configured to alternately or simultaneously stabilize the outputs of two voltage generators in accordance with an exemplary embodiment of the inventive concept. The voltage stabilizer 120 is configured in FIG. 2A to alternately or simultaneously stabilize the positive voltage Vout1 output by a first voltage generator (Amplifier1) and the negative voltage Vout2 output by a second voltage generator (Amplifier2). The voltage stabilizer 120 includes a first switch SW1 and a second switch SW2 and a shared capacitor C1.

During "alternate" operation, only one of the first switch SW1 and the second switch SW2 will be closed at any given time. The first switch SW1 may be implemented as an n-type transistor (e.g., NFET) while the second switch SW2 is implemented as a p-type transistor (e.g., PFET). In that case, a single binary switch-control signal input to both of the first switch SW1 and the second switch SW2 will control one of them to be ON while the other one is OFF.

Although the voltage stabilizer 120 is shown as having two inputs at nodes (a) and (b), and two outputs at nodes (c) and (d), it will be understood that nodes (a) and (c) and the line between them may all be a single node a-c, and similarly that that nodes (b) and (d) and the line between them may all be a single node b-d.

The shared capacitor C1 is preferably an external capacitor and thus contact pads indicated by the label X inside a rectangle are provided on an exterior surface of a chip package housing the integrated circuit including the voltage stabilizer 120. One contact pads is electrically connected to node a-c and the other contact pad is electrically connected to node b-d. The voltage stabilizer 120 may be formed on the same integrated circuit as Amplifier1 and Amplifier2. The two electrodes of the external shared capacitor C1 may be electrically connected to nodes a-c and b-d by a mobile device manufacturer by soldering and/or by welding wires connected to the electrodes of the external shared capacitor C1 to the contact pads indicated by the label X inside rectangles.

FIG. 2B1 is a circuit diagram of the voltage stabilizer 120 shown in FIG. 2A operating in a first mode under the control of mode controller 1238. During a first mode of operation, as illustrated in FIG. 2B1, the second switch SW2 is closed and the first switch SW1 is open, and thus the negative (−) electrode of the capacitor C1 is connected to ground through the second switch SW2, and the positive (+) electrode of the capacitor C1 is connected to the output of the first voltage generator (Amplifier1). Thus, while operating in the first mode, the shared capacitor C1 will stabilize the output Vout1 of the first voltage generator (Amplifier1), and thus an output voltage ripple and a voltage drop thereof may be prevented, so that driving voltages of the display device may be stabilized. While operating in the first mode, the positive voltage generator (Amplifier1) is enabled to output positive voltage Vout1, but the negative voltage generator (Amplifier2) is disabled and outputs no voltage. When the negative voltage generator (Amplifier2) is disabled, its output terminal (at node b) is preferably in a high-resistance (OFF) state, and/or its output is disconnected or is grounded. As illustrated in FIG. 2B1, the negative voltage generator (Amplifier2) may be disabled (deactivated) by the same mode-control signal that activates (closes) the second switch SW2. Thus, the voltage stabilizer 120-1 operating under the control of mode-controller 1238 operates as if the second switch SW2 is a double-throw switch that alternately connects the negative (−) electrode of the shared capacitor C1 to ground and to the negative voltage generator (Amplifier2).

FIG. 2B2 is a circuit diagram of an alternative implementation 120-2 of the voltage stabilizer 120-1 shown in FIG. 2A operating in the first mode under the control of mode controller 1238. The voltage stabilizer 120-2 is essentially the same as the voltage stabilizer 120-1 shown in FIG. 2B1, except that the switch SW1 is implemented explicitly as a double-throw switch that alternately connects the negative (−) electrode of the shared capacitor to ground and to the negative voltage generator (Amplifier2). Thus, the same reference numerals will be used to refer to the same or like elements as those described in FIG. 2B1 and a redundant explanation thereof will be omitted.

In this alternative embodiment, while operating in the first mode, the negative voltage generator (Amplifier2) can remain enabled (active) and can continue to output the negative voltage Vout2 at node (b) while the negative (−) electrode of the shared capacitor is connected to ground. Thus, while operating in the first mode, the shared capacitor C1 will stabilize the positive voltage Vout1 output by the enabled first voltage generator (Amplifier1), and the unstabilized negative voltage Vout2 output by the enabled second voltage generator (Amplifier2) will meanwhile also be available. Thus an output voltage ripple and a voltage drop of the positive voltage Vout1 output by the enabled first voltage generator (Amplifier1) may be prevented, so that driving voltages of the display device may be stabilized.

Figure 2C:
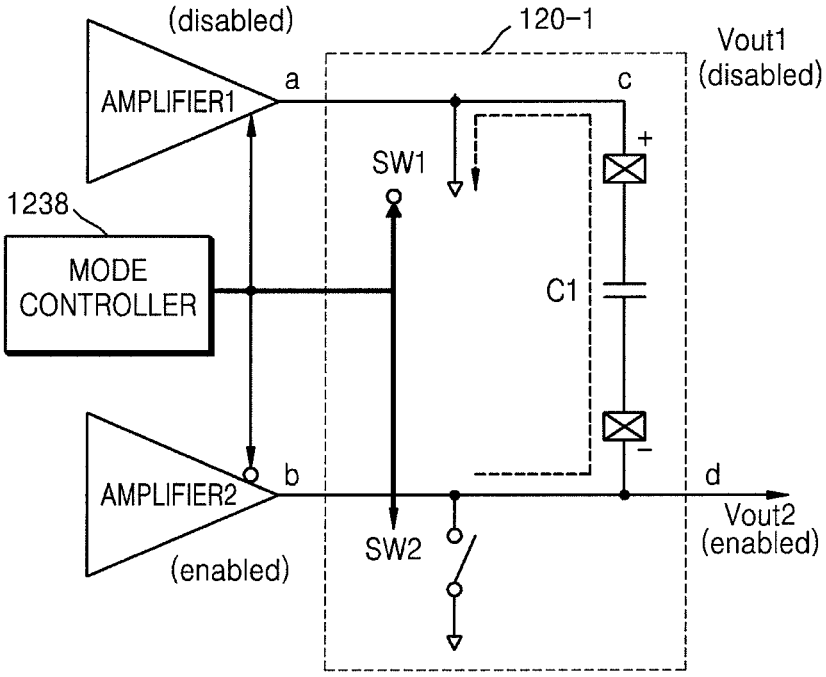
FIG. 2C is a circuit diagram of the voltage stabilizer shown in FIG. 2A operating in a second mode.

FIG. 2C is a circuit diagram of the voltage stabilizer 120 shown in FIG. 2A operating in the second mode under the control of mode-controller 1238. During the second mode of operation, as illustrated in FIG. 2C, the first switch SW1 is closed, and thus the positive (+) electrode of the capacitor C1 is connected to ground through the first switch SW1, and the negative (−) electrode of the capacitor C1 is connected to the output of the second voltage generator (Amplifier2). Thus, while operating in the second mode, the shared capacitor C1 will stabilize the output Vout2 of the second voltage generator (Amplifier2), and thus an output voltage ripple and a voltage drop thereof may be prevented, so that driving voltages of the display device may be stabilized.

While operating in the second mode, the negative voltage generator (Amplifier2) is enabled to output negative voltage Vout2, but the positive voltage generator (Amplifier1) is disabled and outputs no voltage. When the positive voltage generator (Amplifier1) is disabled, its output terminal (at node a) is preferably in a high-resistance (OFF) state, and/or its output is disconnected or is grounded. As illustrated in FIG. 2B1, the positive voltage generator (Amplifier1) may be disabled (deactivated) by the same mode-control signal that activates (closes) the second switch SW1. Thus, the voltage stabilizer 120-1 operates under the control of mode-controller 1238 as if the first switch SW1 is a double-throw switch that alternately connects the positive (+) electrode of the shared capacitor C1 to ground and to the positive voltage generator (Amplifier1).

Referring again to FIG. 2A, a third mode of operation is supported by the voltage stabilizer 120 in which the first voltage generator (Amplifier1) and the second voltage generator (Amplifier2) are both enabled and both of the first switch SW1 and the second switch SW2 are both closed at the same time. In this mode of operation, positive output Vout1 of the first voltage generator (Amplifier1) and the negative output Vout2 of the second voltage generator (Amplifier2) are capacitively coupled by the shared capacitor C1, and neither is connected to ground by the first switch SW1 or the second switch SW2.

In various other embodiments of the inventive concept, the voltage stabilizer 120 shown in FIG. 2A may be employed as a stabilizing circuit in a driver IC of a display (e.g., in an OLED, LCD) that also includes non-volatile memory cells or MTP (Multiple Time Programmable) cells for storing gamma, configuration, and user settings. Thus the DC to DC converter of the display may include a positive voltage generator configured to output various high voltages (Vout1) (e.g., +15.5 volts to +17 volts) associated with erasing (ERS) and programming (PRG) non-volatile memory cells and a negative voltage generator configured to output a negative voltage VINT (Vout2) of about −0.6 to −3.6 volts. In this case, a shared exterior capacitor C1 can alternately stabilize the high PGM/ERS (Vout1) voltage or the negative VINT (Vout2) voltage. Either of the high PGM/ERS (Vout1) voltage and the negative VINT (Vout2) voltage is available externally of the IC containing the switches SW1 and SW2 of the voltage stabilizing circuit at the electrodes of the external shared capacitor C1 and at the external contact pads connected thereto. Internal (on-chip) nonvolatile memory, e.g., EPROM (Erasable and Programmable Read Only Memory) or flash based nonvolatile memory, makes it possible to minimize externally-connected memory, enabling smaller and lower-priced LCD panel modules to be produced.

Figure 3A:
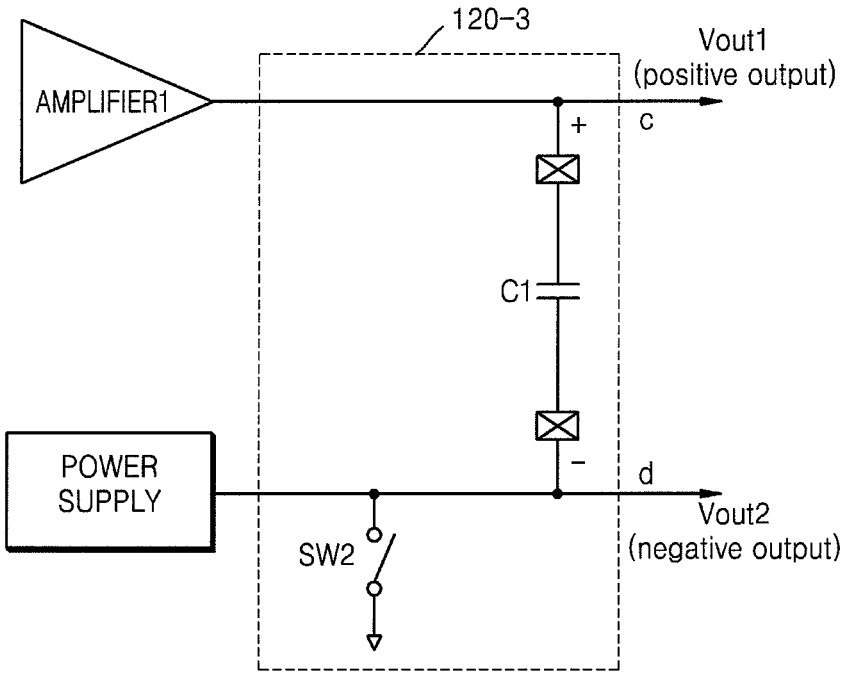
FIG. 3A is a circuit diagram of a voltage stabilizer in accordance with another exemplary embodiment of the present inventive concept.

FIG. 3A is a circuit diagram of a voltage stabilizer 120-3 in accordance with another exemplary embodiment of the present inventive concept. The voltage stabilizer 120-3 is essentially the same as the voltage stabilizer 120 shown in FIG. 2A, except that the first switch SW1 is implemented as always-open, and thus is explicitly omitted. Thus, the same reference numerals will be used to refer to the same or like elements as those described in FIG. 2A and a redundant explanation thereof will be omitted.

Because the first switch SW1 is omitted, the voltage stabilizer 120-3 cannot operate to stabilize the negative voltage Vout2 in the second mode in which the positive (+) electrode of the shared capacitor C1 is connected to ground through the first switch SW1. Only the second switch SW2 alternately connects and disconnects the negative (−) electrode of the shared capacitor to ground. However, if the first voltage generator (Amplifier1) can be disabled so that its output is grounded, second mode operation in which the shared capacitor C1 is connected to ground through the positive voltage generator (Amplifier1) is achievable, and the negative voltage Vout2 may be thereby stabilized by capacitive coupling to ground.

Figure 3B:
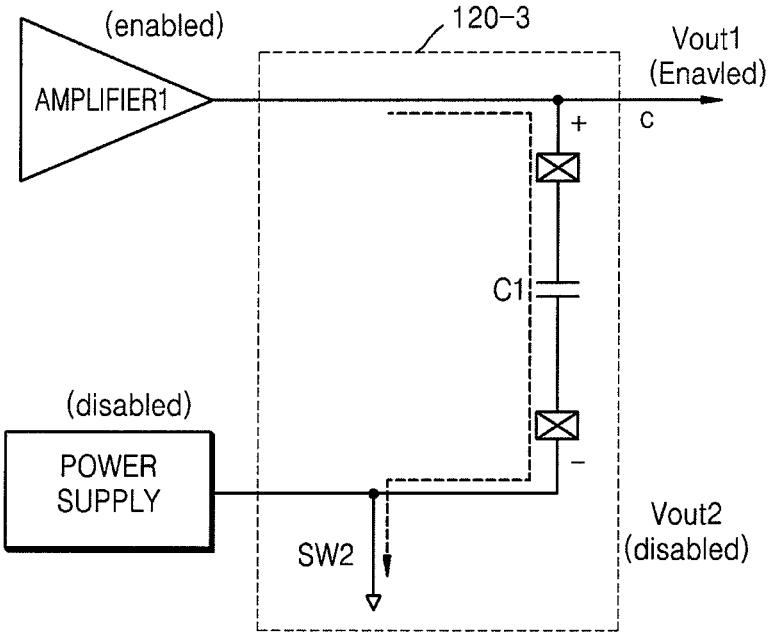
FIG. 3B is a circuit diagram of the voltage stabilizer shown in FIG. 3A operating in the third mode.
Figure 3C:
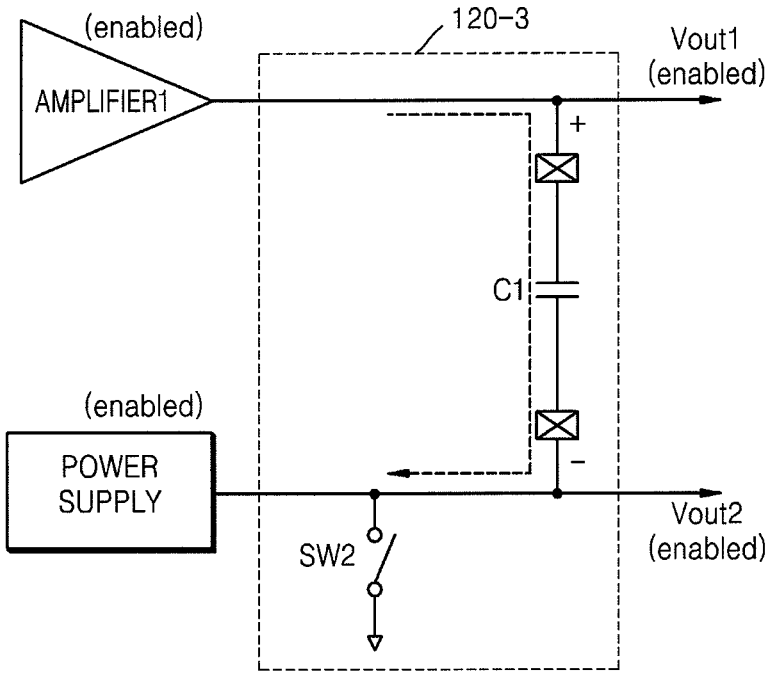
FIG. 3C is a circuit diagram of the voltage stabilizer shown in FIG. 3A operating in a first mode.

The voltage stabilizer 120-3 supports the third mode of operation illustrated in FIG. 3C in which the first voltage generator (Amplifier1) and the second voltage generator (Amplifier2) are both enabled and both are connected to the electrodes of the shared capacitor C1. In this mode of operation, positive output Vout1 of the first voltage generator (Amplifier1) and the negative output Vout2 of the second voltage generator (Amplifier2) are capacitively coupled by the shared capacitor C1, and neither is connected to ground by the second switch SW2.

In FIGS. 3A, 3B, and 3C, the voltage stabilizer 120-3 is configured to be connected to two different types of voltage generators. The positive voltage generator is shown implemented as Amplifier1 while the negative voltage generator is implemented by a power supply. The negative voltage Vout2 output by the power supply may be already stabilized and may not require additional stabilization by shared capacitor C1, and in the third mode of operation the capacitive coupling therebetween may serve to stabilize the positive voltage Vout1.

FIG. 3B is a circuit diagram of the voltage stabilizer 120-3 shown in FIG. 3A operating in the first mode. The voltage stabilizer 120-3 shown in FIG. 3B may operate in the first mode under the control of mode controller 1238 (not shown) as illustrated in FIG. 2B1. While operating in the first mode, the positive voltage generator (Amplifier1) is enabled, the second switch SW2 is closed, and the negative voltage generator (power supply) is disabled. When the negative voltage generator (power supply) is disabled, its output terminal is preferably in a high-resistance (OFF) state, and/or its output is disconnected or is grounded.

Thus, while operating in the first mode, the negative (−) electrode of the capacitor C1 is connected to ground through the second switch SW2, and the positive (+) electrode of the capacitor C1 is connected to the output Vout1 of the positive voltage generator (Amplifier1). Thus, while operating in the first mode, the shared capacitor C1 will stabilize the output Vout1 of the positive voltage generator (Amplifier1), and thus an output voltage ripple and a voltage drop thereof may be prevented, so that driving voltages of the display device may be stabilized. The negative voltage generator (Amplifier2) may be disabled (deactivated) by the same mode-control signal that activates (closes) the second switch SW2, the same as illustrated in FIG. 2B1. Thus, the voltage stabilizer 120-3 operating under the control of mode-controller 1238 as shown in FIG. 2B1 operates as if the second switch SW2 is a double-throw switch that alternately connects the negative (−) electrode of the shared capacitor C1 to ground and to the negative voltage generator (Amplifier2).

FIG. 3C is a circuit diagram of the voltage stabilizer 120-3 shown in FIG. 3A operating in the third mode. In the third mode of operation in the first voltage generator (Amplifier1) and the second voltage generator (Amplifier2) are both enabled and both are connected to the electrodes of the shared capacitor C1. If the negative voltage Vout2 output by the power supply is already stabilized, in the third mode of operation the capacitive coupling therebetween may serve to stabilize the positive voltage Vout1.

Figure 3D:
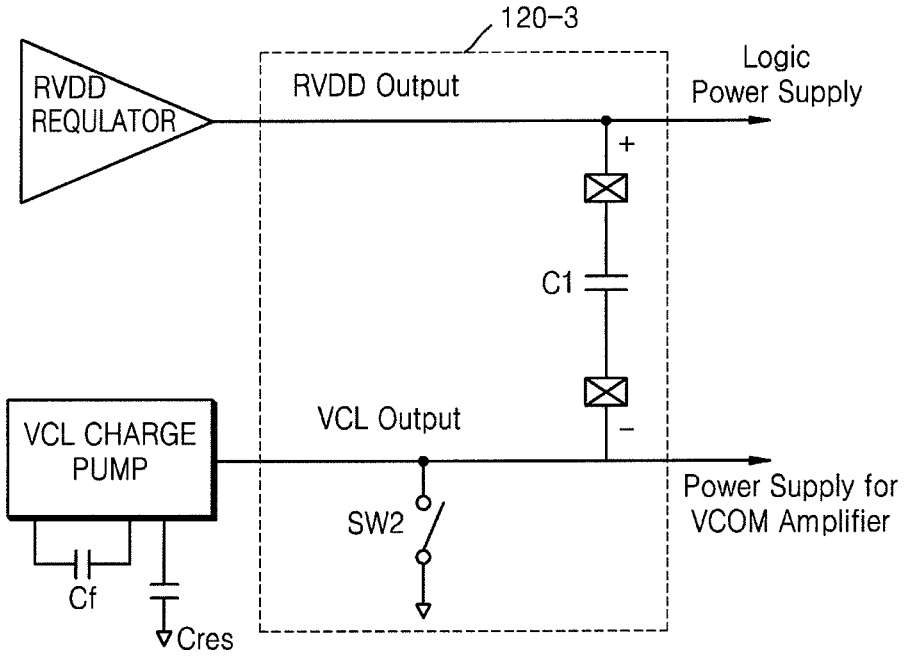
FIG. 3D is a circuit diagram of the voltage stabilizer shown in FIG. 3A connected to a positive regulated voltage RVDD generator.

FIG. 3D is a circuit diagram of the voltage stabilizer 120-3 shown in FIG. 3A configured to stabilize a positive regulated voltage RVDD. In FIG. 3D the positive voltage generator outputs a regulated voltage RVDD, and the negative voltage generator is implemented as a charge pump having its own flying capacitor $C_f$ and a "reservoir" capacitor $C_{res}$. A charge pump may be considered a type of direct current (DC) to DC converter that uses capacitors $C_f$ and $C_{res}$ as energy storage elements to create either a higher or lower voltage from an input voltage source such as a battery. The output of the charge pump may be sufficiently stabilized, especially if the reservoir capacitor $C_{res}$ is large enough. Alternatively, the RVDD voltage regulator may stabilize the positive voltage at the positive (+) electrode of the shared capacitor C1, and thus the output of the charge pump may be stabilized by capacitive coupling through the shared capacitor C1. The voltage stored in the shared capacitor C1 is charged to the level of |RVDD−VCL|.

The charge pump may generate a negative internal voltage VGL wherein the predetermined negative voltage VCL may be about −2.7 V. The negative voltage VCL output by the negative voltage generator (charge pump) may be used as the common voltage of the LCD panel of a QVGA (240RGB× 320 pixels) resolution LCD or in a higher resolution WVGA (800×480 pixels) LCD.

Figure 1A:
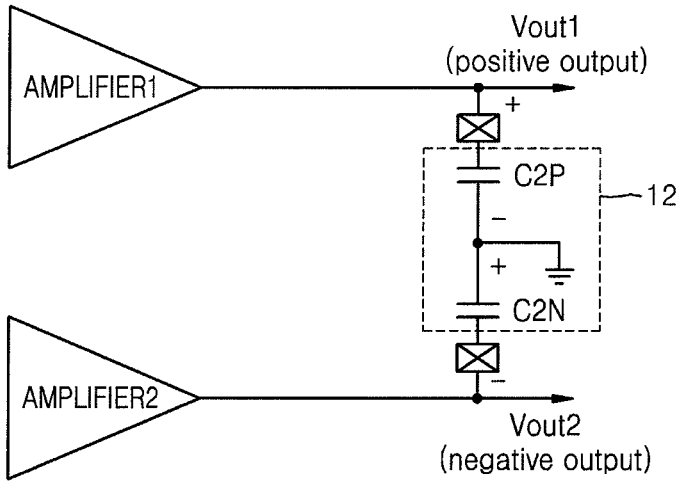
FIG. 1A (PRIOR ART)
FIG. 1A is a circuit diagram of a conventional voltage stabilizer.
Figure 1B:
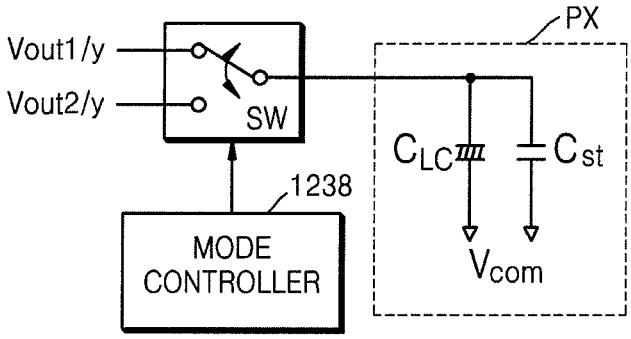
FIG. 1B (PRIOR ART)
FIG. 1B is a circuit diagram of a conventional double-throw switch connected to a pixel of a liquid crystal display (LCD)
Figure 4:
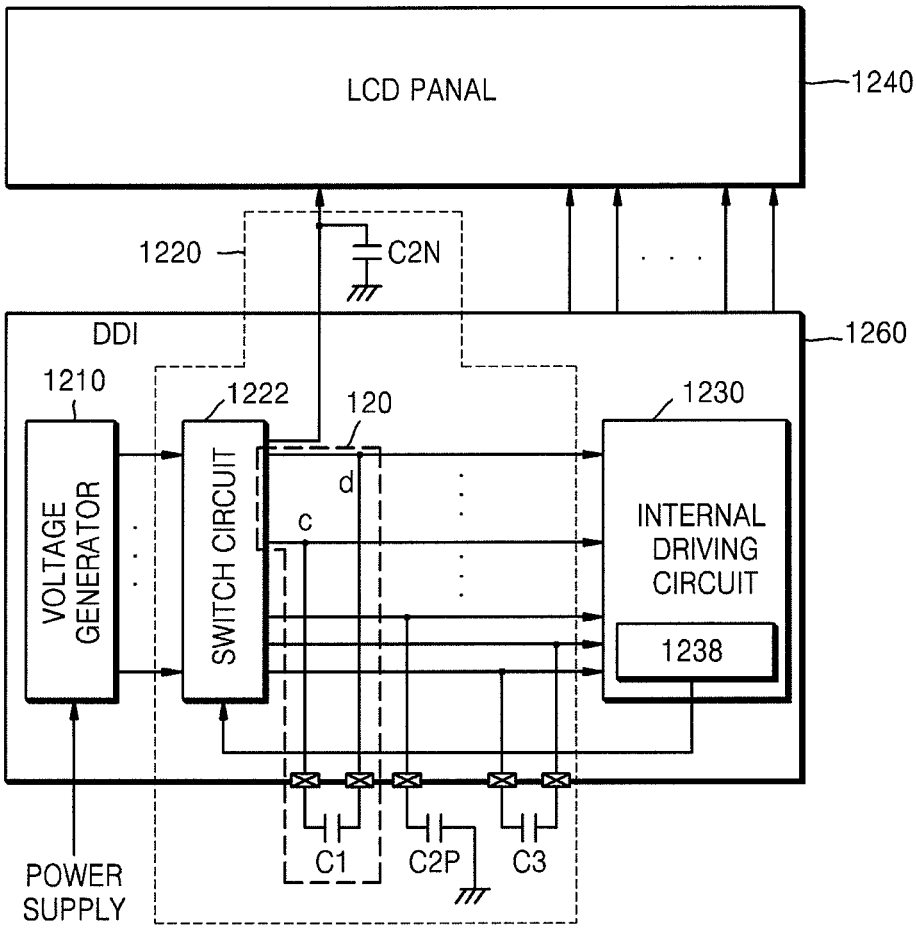
FIG. 4 is a block diagram of a liquid crystal display (LCD) including a plurality of the stabilizing circuits of FIG. 2A, according to an embodiment of the inventive concept.

FIG. 4 is a block/circuit diagram of a liquid crystal display (LCD) device including a plurality of the stabilizing circuits 120 of FIG. 2A, according to an embodiment of the inventive concept. The display device of FIG. 4 includes a LCD panel 1240, a display driving IC (DDI) 1260 and external capacitors (e.g., C1, C2P, C2N, C3). The LCD panel 1240 includes a backlight, a transparent thin film transistor (TFT) pixel array substrate, a liquid crystal (LC) layer, and a color filter. An array of pixels PX as illustrated in FIG. 1B are formed in the LCD panel 1240.

The display driving IC (DDI) 1260 includes a plurality of voltage generators 1210, a portion of a voltage stabilizing unit 1220, and an internal driving circuit 1230. External power is supplied to the liquid crystal display (LCD) device from a power supply, (e.g., a battery). The stabilizing unit 1220 includes the switches (SW1, SW2) of a plurality of the stabilizing circuits 120 of FIG. 2A (e.g., 120-1, 120-2, and/or 120-3) and the external capacitors (e.g., C1, C2P, C2N, C3). The stabilizing unit 1220 includes the stabilizing circuit 120 of FIG. 2A (e.g., 120-1, 120-2, and/or 120-3) and also two conventional stabilizing circuits of FIG. 1A. A first one of the stabilizing circuits 120 of FIG. 2A is connected to external capacitor C1. A second one of the stabilizing circuits 120 of FIG. 2A is connected to external capacitor C3. A first one of the conventional stabilizing circuits of FIG. 1A is connected to external capacitor C2P and employed to stabilize a negative voltage Vcom supplied to the LCD panel 1240. A second one of the conventional stabilizing circuits of FIG. 1A is connected to external capacitor C2N to stabilize a positive voltage.

The portion of the stabilizing unit 1220 formed on the integrate circuit includes the switches SW1 and SW2 of the stabilizing circuits 120 of FIG. 2A (e.g., 120-1, 120-2, and/or 120-3), which are grouped within a switching unit 1222 disposed between the plurality of voltage generators 1210 and the internal driving circuit 1230. The internal driving circuit 1230 includes a pixel polarity inversion mode controller 1238 that may control the switches SW1 and SW2 of the stabilizing circuits 120 of FIG. 2A (e.g., 120-1, 120-2, and/or 120-3) as described hereinabove.

Figure 5:
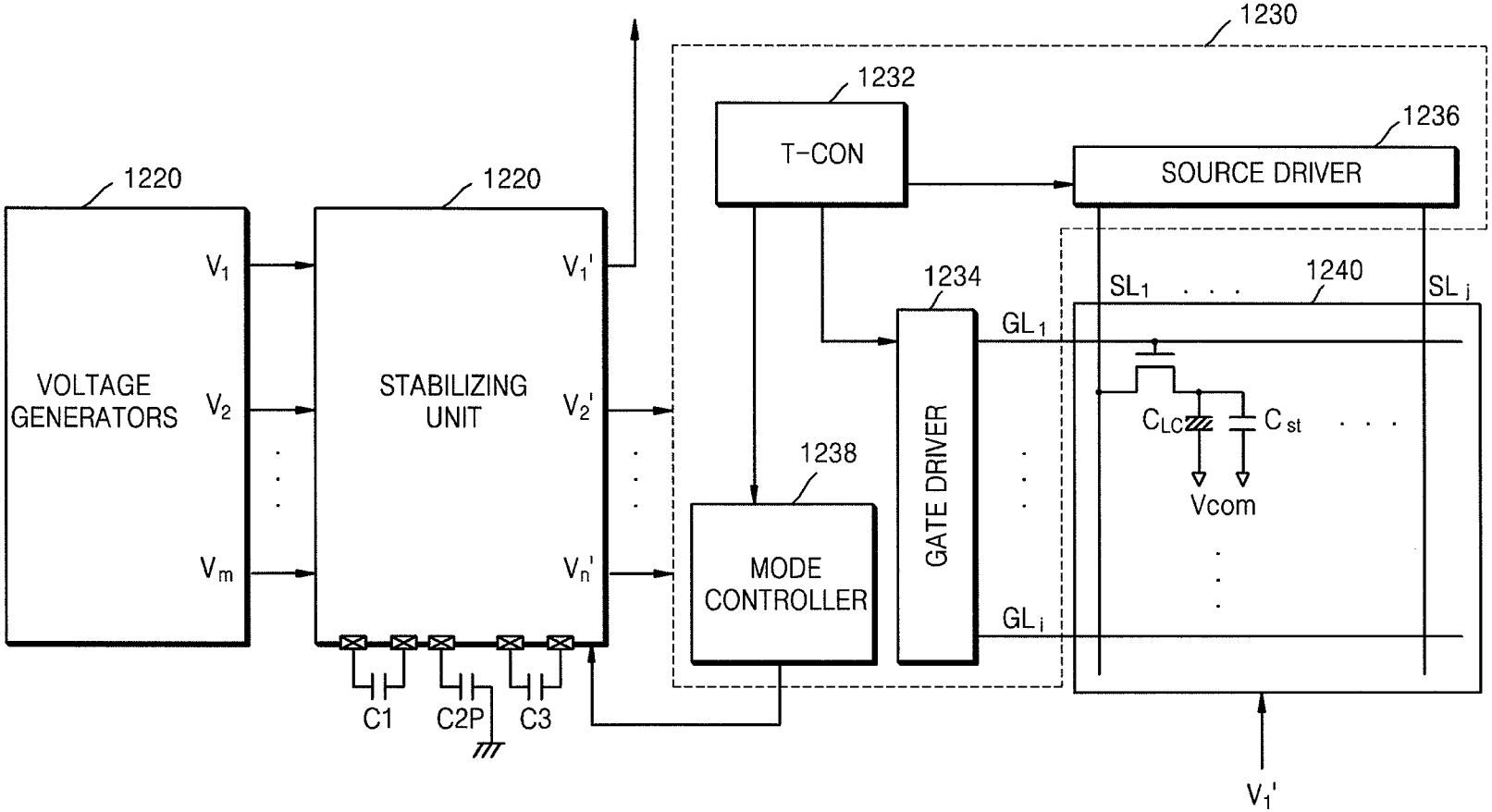
FIG. 5 is a block diagram of a liquid crystal display (LCD) device including at least one stabilizing circuit 120 of FIG. 2A, according to an embodiment of the inventive concept.

FIG. 5 is a block diagram of a liquid crystal display (LCD) device including at least one stabilizing circuit 120 of FIG. 2A, according to an embodiment of the inventive concept. The liquid crystal display (LCD) device of FIG. 5 is essentially the same as the liquid crystal display (LCD) device shown in FIG. 4, except that the plurality of voltage generators 1210, the stabilizing unit 1220 and the internal driving circuit 1230 are not necessarily formed on the same integrated circuit. For example, in various exemplary embodiments, the stabilizing unit 1220 (except the external capacitors) and the internal driving circuit 1230 are formed on the same integrated circuit chip while the plurality of voltage generators are formed on a different integrated circuit chip. The LCD panel 1240 may be conventional an includes a plurality of pixels PX, wherein each pixel in the LCD panel 1240 includes a liquid crystal layer that has a capacitance $C_{LC}$ and a storage capacitor that has capacitance $C_{st}$.

The stabilized driving voltages output from the stabilizing unit 1220 may include gate voltages VSS and VDD, a gamma reference voltage VREF, a common voltage $V_{COM}$, etc. The gate voltages VSS and VDD are supplied from the stabilizing unit 1220 to the gate line driver 1234. The stabilized voltage V1' output by the stabilizing unit 1220 is applied to the LCD panel 1240 to serve as the common electrode voltage $V_{COM}$ of the pixels PX in the LCD panel 1230.

The internal driving circuit 1230 includes a gate line driver 1234, a source line driver 1236, a control signal generator T-CON 1232, and pixel polarity inversion mode controller 1238. The gate line driver 1234 includes a plurality (i+1) of driving stages that are cascade connected to one another to sequentially drive the plurality (i+1) of gate lines in the LCD panel 1240. An output terminal OUT of the each of the driving stages is connected to one of the (i+1) gate lines GL1~GLi. A vertical start signal STV is applied by T-CON 1232 to the gate line driver 1234, and the operation of the mode controller 1238 may be synchronized with the operation of the gate line driver 1234 and/or of the source driver 1236. The timing control signal generator T-CON 1232 may output a pixel inversion (mode control) signal that is passed to the source line driver 1236 and to the stabilizing unit 1220.

An LCD display device of FIG. 4 or of FIG. 5 according to any embodiment of the inventive concept may be included in a computing system that also includes a central processing unit (CPU), a ROM, a RAM (e.g. a DRAM), input/output (I/O) devices, and a solid state drive (SSD) all connected to a system bus. Examples of the computing system include personal computers, mainframe computers, laptop computers, cellular phones, personal digital assistants (PDAs), digital cameras, GPS units, digital TVs, camcorders, portable audio players (e.g., MP3), and portable media players (PMPs).

Although the exemplary embodiments of the present inventive concept have been described, it is understood that the present inventive concept should not be limited to these exemplary embodiments but various changes and modifications can be made by one ordinary skilled in the art within the spirit and scope of the present inventive concept as hereinafter claimed.

What is claimed is:

1. A voltage stabilizing circuit of a display driver integrated circuit comprising:

a capacitor having a first electrode selectably connected to a first input voltage node through a first switch during a first time period and not during a second time period and having a second electrode selectably connected to a second input voltage node through a second switch during the second time period and not during the first time period, the first input voltage node being connected to a first voltage generator and the second input voltage node being connected to a second voltage generator, wherein a first stabilized voltage is output at a first output voltage node that is directly connected to the first electrode while the first switch connects the first electrode to the first input voltage node and while the second switch connects the second electrode to ground, wherein a second stabilized voltage is output at a second output voltage node that is directly connected to the second electrode while the second switch connects the second electrode to the second voltage node and while the first switch connects the first electrode to ground, wherein the first switch connects the first electrode to one of the first input voltage node and ground alternately, and wherein the second switch connects the second electrode to one of the second input voltage node and ground alternately.

2. The voltage stabilizing circuit of claim 1, wherein the absolute value of the first stabilized voltage is substantially the same as the absolute value of the second stabilized voltage.

3. A voltage stabilizing circuit of a display driver integrated circuit comprising:

a shared capacitor connected between a first input node and a second input node, a first electrode of the shared capacitor being connected to the first input node and a second electrode of the shared capacitor being connected to the second input node;

a first switch for switchably connecting the first electrode of the shared capacitor to ground during a second time period and not during a first time period, wherein the first electrode is directly connected to a first voltage node, wherein the first voltage node is a first output node of the voltage, stabilizing circuit; and a second switch for switchably connecting the second electrode of the shared capacitor to ground, wherein the second electrode is directly connected to a second voltage node, wherein the second voltage node is a second output node of the voltage stabilizing circuit, wherein the first voltage node of the voltage stabilizing circuit outputs a first stabilized voltage while the second switch is closed to connect the second electrode of the shared capacitor to ground and while the first electrode of the shared capacitor is not connected to ground.

4. The voltage stabilizing circuit of claim 3, wherein one of the first and second stabilized voltages is positive and other one of the first and second stabilized voltages is negative.

5. The voltage stabilizing circuit of claim 4, wherein the second voltage node of the voltage stabilizing circuit outputs a second stabilized voltage during the second time period while the first switch connects the first electrode of the shared capacitor to ground and while the second electrode of the shared capacitor is not connected to ground.

6. The voltage stabilizing circuit of claim 4, wherein the first voltage node of the voltage stabilizing circuit outputs a first stabilized voltage and the second voltage node of the voltage stabilizing circuit outputs a second stabilized voltage during a third time period while neither the first electrode nor the second electrode of the shared capacitor is connected to ground.

7. The voltage stabilizing circuit of claim 6, wherein the potential difference between the first stabilized voltage and the second stabilized voltage is substantially the same as the voltage between the first electrode and the second electrode.

8. The voltage stabilizing circuit of claim 4, wherein one of the first and second stabilized voltages is positive and other one of the first and second stabilized voltages is negative.

9. The voltage stabilizing circuit of claim 8, wherein the absolute value of the first stabilized voltage is substantially the same as absolute value of the second stabilized voltage.

10. The voltage stabilizing circuit of claim 4, further comprising:

wherein the first electrode of the shared capacitor is switchably connected. to the first input node by the first switch during the first time period, and wherein the second electrode of the shared capacitor is switchably connected to the second input node by the second switch during; the second time period.

11. An apparatus comprising:

a voltage stabilizing circuit comprising:

a shared capacitor connected between a first input node and a second input node, a first electrode of the shared capacitor being connected to the first input node and a second electrode of the shared capacitor being connected to the second input node;

a first switch for switchably connecting the first electrode of the shared capacitor to ground during a second time period and not during a first time period, wherein the first electrode is directly connected to a first voltage node during the first and second time periods, wherein the first voltage node is a first output node of the voltage stabilizing circuit; and a second switch for switchably connecting a second electrode of the shared capacitor to ground during the first time period and not during the second time period, wherein the second electrode is directly connected to a second voltage node, wherein the second voltage node is a second output node of the stabilizing circuit, a first voltage generator configured to generate a first voltage to be stabilized by the shared capacitor during a first time period and not during a second time period and to be output by the voltage stabilizing circuit as a first stabilized voltage during the first time period; and a second voltage generator configured to generate a second voltage to be stabilized by the shared capacitor during the second time period and not during the first time period and to be output by the voltage stabilizing circuit as a second stabilized voltage during the second time period.

12. The apparatus of claim 11, further comprising:

an internal driving circuit of a display panel.

13. The apparatus of claim 12, wherein the display panel is a QVGA or WVGA liquid crystal display (LCD) panel.

14. The apparatus of claim 13, wherein the first and second stabilized voltages are alternately stabilized, and wherein the first and second stabilized voltages are alternatively applied by the voltage stabilizing circuit to the internal driving circuit.

15. The apparatus of claim 14, wherein the first and second stabilized voltages are alternately stabilized and applied by the voltage stabilizing circuit to the internal driving circuit according to a pixel polarity inversion scheme of the display panel.

16. The apparatus of claim 12, wherein the first switch and the second switch are alternately controlled by an output of the internal driving circuit, and wherein the internal driving circuit includes a gate line driver and a source line driver.

17. The apparatus of claim 12, wherein the first and second stabilized voltages are alternately stabilized, and wherein the first and second stabilized voltages are alternately applied by the voltage stabilizing circuit to the internal driving circuit.

18. The apparatus of claim 12, further comprising:

wherein the display panel is an OLED panel, wherein the internal driving circuit includes a gate line driver and a source line driver.

19. The apparatus of claim 12, wherein the gate line driver, the source line driver, the first switch and the second switch are formed on one integrated circuit chip.

* * * * *